US007380736B2

(12) United States Patent
Nemedi

(10) Patent No.: US 7,380,736 B2
(45) Date of Patent: Jun. 3, 2008

(54) IN-LINE SHREDDER APPARATUS AND METHOD FOR SHREDDING MATERIALS

(75) Inventor: William D. Nemedi, Paw Paw, MI (US)

(73) Assignee: Inter-Source Systems, Inc., Kalamazoo, MI (US)

( * ) Notice: Subject to any disclaimer, the term of this patent is extended or adjusted under 35 U.S.C. 154(b) by 194 days.

(21) Appl. No.: 11/121,659

(22) Filed: May 4, 2005

(65) Prior Publication Data

US 2006/0249608 A1 Nov. 9, 2006

(51) Int. Cl.
*B02C 17/00* (2006.01)
*B02C 23/36* (2006.01)

(52) U.S. Cl. ..... 241/26; 241/46.06; 241/243

(58) Field of Classification Search ..... 241/243, 241/46.06, 26
See application file for complete search history.

(56) References Cited

U.S. PATENT DOCUMENTS 2,753,085 A * 7/1956 Plummer ..... 222/623
3,396,914 A * 8/1968 Liebman ..... 241/63
3,690,335 A 9/1972 Hirohisa et al.
3,960,335 A 6/1976 Häberle
4,000,858 A 1/1977 Rudzinski
4,186,888 A 2/1980 Galanty
4,205,799 A 6/1980 Brewer
4,284,247 A * 8/1981 Eriksson ..... 241/260.1
4,377,259 A 3/1983 Areaux et al.
4,424,891 A 1/1984 Dudley et al.
4,629,134 A 12/1986 Pennekamp
4,691,871 A * 9/1987 Mochizuki ..... 241/166
4,936,822 A 6/1990 Nemedi
5,106,487 A 4/1992 Nemedi
5,110,060 A 5/1992 Lundquist
5,135,178 A 8/1992 Strohmeyer
5,236,139 A 8/1993 Radtke
5,252,208 A 10/1993 Nemedi
5,264,124 A 11/1993 Nemedi
5,275,727 A 1/1994 Nemedi
5,330,637 A 7/1994 Nemedi
5,345,665 A 9/1994 Nemedi
5,383,941 A 1/1995 Nemedi
RE35,307 E 7/1996 Nemedi
5,639,035 A * 6/1997 Maugle et al. ..... 241/236
5,680,999 A 10/1997 Wada
5,799,884 A * 9/1998 Alavi ..... 241/27
5,803,143 A 9/1998 Willis
5,944,992 A 8/1999 Nemedi et al.
6,079,645 A 6/2000 Henreckson et al.

(Continued)

OTHER PUBLICATIONS

Chip Processing (Brochure), Inter-Source Recovery Systems, Inc. (circa 1999).
"Two-Stage Scrap Metal Shredder," U.S. Appl. No. 08/785,645, filed 1997—abandoned.

*Primary Examiner*—Bena Miller
(74) *Attorney, Agent, or Firm*—Marshall, Gerstein & Borun LLP

(57) ABSTRACT

A shredder apparatus has a moveable, shaftless ring component and a secondary comb member component. The ring component and the secondary component cooperate to shred material. The shredder mechanism may be positioned so as to be substantially in-line with the material entering the shredder. The shredder apparatus may be used in a method for shredding materials.

30 Claims, 15 Drawing Sheets

U.S. PATENT DOCUMENTS

| | | | | |
|---|---|---|---|---|
| 6,094,795 | A | 8/2000 | Davenport | |
| 6,125,992 | A | 10/2000 | Dudley | |
| 6,126,099 | A | 10/2000 | Fachinger et al. | |
| 6,129,851 | A | 10/2000 | Nemedi et al. | |
| 6,253,929 | B1 | 7/2001 | Nemedi et al. | |
| 6,375,841 | B1 | 4/2002 | Nemedi et al. | |
| 6,405,877 | B1 | 6/2002 | Nemedi et al. | |
| 6,513,741 | B2 * | 2/2003 | Hsu | 241/236 |
| 6,540,087 | B2 | 4/2003 | Nemedi et al. | |
| 6,572,779 | B2 | 6/2003 | Nemedi et al. | |
| 2003/0178518 | A1 | 9/2003 | Nemedi | |
| 2005/0001080 | A1 | 1/2005 | Nemedi | |
| 2006/0118666 | A1 * | 6/2006 | Nemedi | 241/21 |

* cited by examiner

IN-LINE SHREDDER APPARATUS AND METHOD FOR SHREDDING MATERIALS

FIELD

The shredder apparatus and method for shredding disclosed herein relate generally to the shredding of wet chip materials that are subsequently separated into dry chips and fluid, and, more specifically, to a shredder apparatus having a shaftless shredder ring component and a shredder comb member component that cooperate to shred wet chip materials.

BACKGROUND

Wet chip materials are generated in the course of machining operations. Often the wet chip material, which can vary in size and configuration, is passed through a shredder apparatus that serves to shred the material prior to its passing on to other work stations, e.g., filtering or centrifugal separation stations.

Shredder apparatuses for shredding wet chip materials are well known in the art. Conventional shredder apparatuses include systems that utilize a plurality of spaced shredder members that are disposed upon a rotatable rotor. One example is the shredder apparatus shown and disclosed in my co-pending U.S. patent application Ser. No. 10/611,526, filed Jul. 1, 2003, the disclosure, drawings and claims of which are incorporated by reference in their entirety herein. Upon actuation of such a shredder apparatus, the rotor rotates, and the shredder members fixed to the rotor rotate and cooperate with shredder comb members to shred material entering the apparatus.

In some instances, however, it has been found that, because of the nature of the material to be shredded, the shredder apparatus experiences difficulty in properly transporting the material to be shredded to the shredder components, such that appropriate shredding does not occur. For example, certain wet chip material, e.g., ball bearing-type scrap material or scrap rings formed in the manufacture of pistons, sometimes fail to shred properly with conventional shredding apparatuses. It has been found that this type of material, once it enters the shredder apparatus, is not properly carried to the shredder components within the shredder apparatus.

What is desired is to have a shredder apparatus that allows for the appropriate shredding of material whereby material to be shredded is properly transported to and within the shredder apparatus.

It is also desired to have a shredder apparatus where the shredder elements that cooperate to shred material are positioned principally orthogonal to the primary flow direction of the material to be shredded.

It is further desired to have a shredder apparatus located at least partially in a coolant flow path so that coolant flowing along the flow path and through the shredder apparatus assists in moving material through the shredder.

Finally, it is desired to have a shredder apparatus where, if desired, the shredding can occur without the requirement of having rotating shredding elements located on a rotating shaft-like member.

SUMMARY

A shredder apparatus may include a shaftless shredder ring component attached to an apparatus frame. The shredder ring component may be a cylindrically-shaped member that includes a plurality of spaced shredder rings. Spacer bars serve to join and space the shredder rings from each other. The shredder ring component is positioned within the frame to be substantially in-line with wet chip or other material entering the shredder apparatus to be shredded.

A secondary shredder component includes a plurality of spaced comb members attached to the frame. Upon rotation of the shredder ring component relative to the comb members, the shredder rings and comb members cooperate to shred material in the shredder apparatus into more discrete wet chips.

Wet chip material enters the shredder apparatus through an opening in a frame wall and passes through one end of the shredder ring component. While in the shredder ring component, the material is shredded due to the cooperation of the comb members and shredder rings. Following a shredding operation, the shredded material passes out of the remaining end of the shredder ring component.

Other advantages of such a shredder apparatus will become apparent from the drawings and the following detailed description of the shredder apparatus and method of shredding.

DETAILED DESCRIPTION

Figure 1:
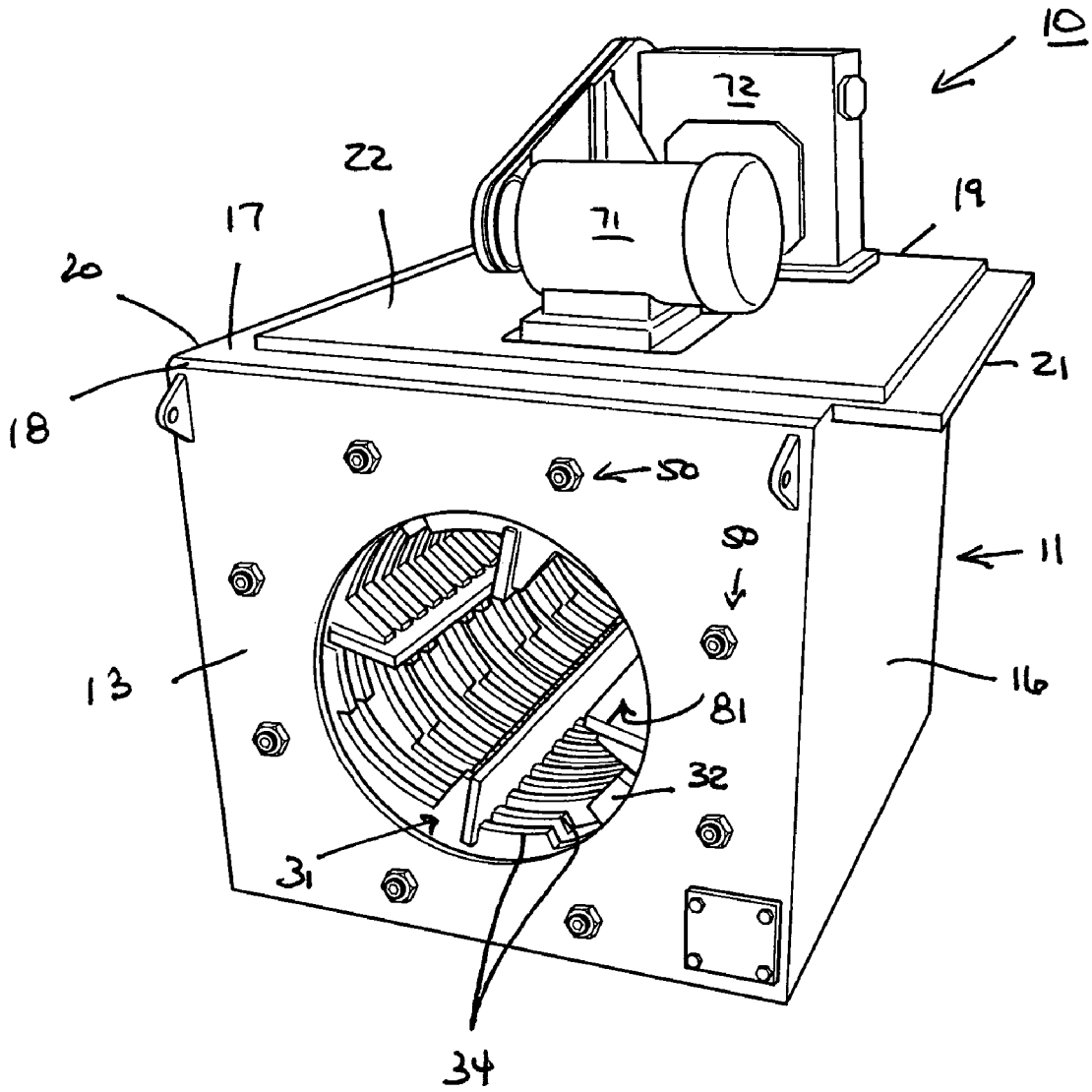
FIG. 1 shows a frontal perspective view of the shredder apparatus.
Figure 2:
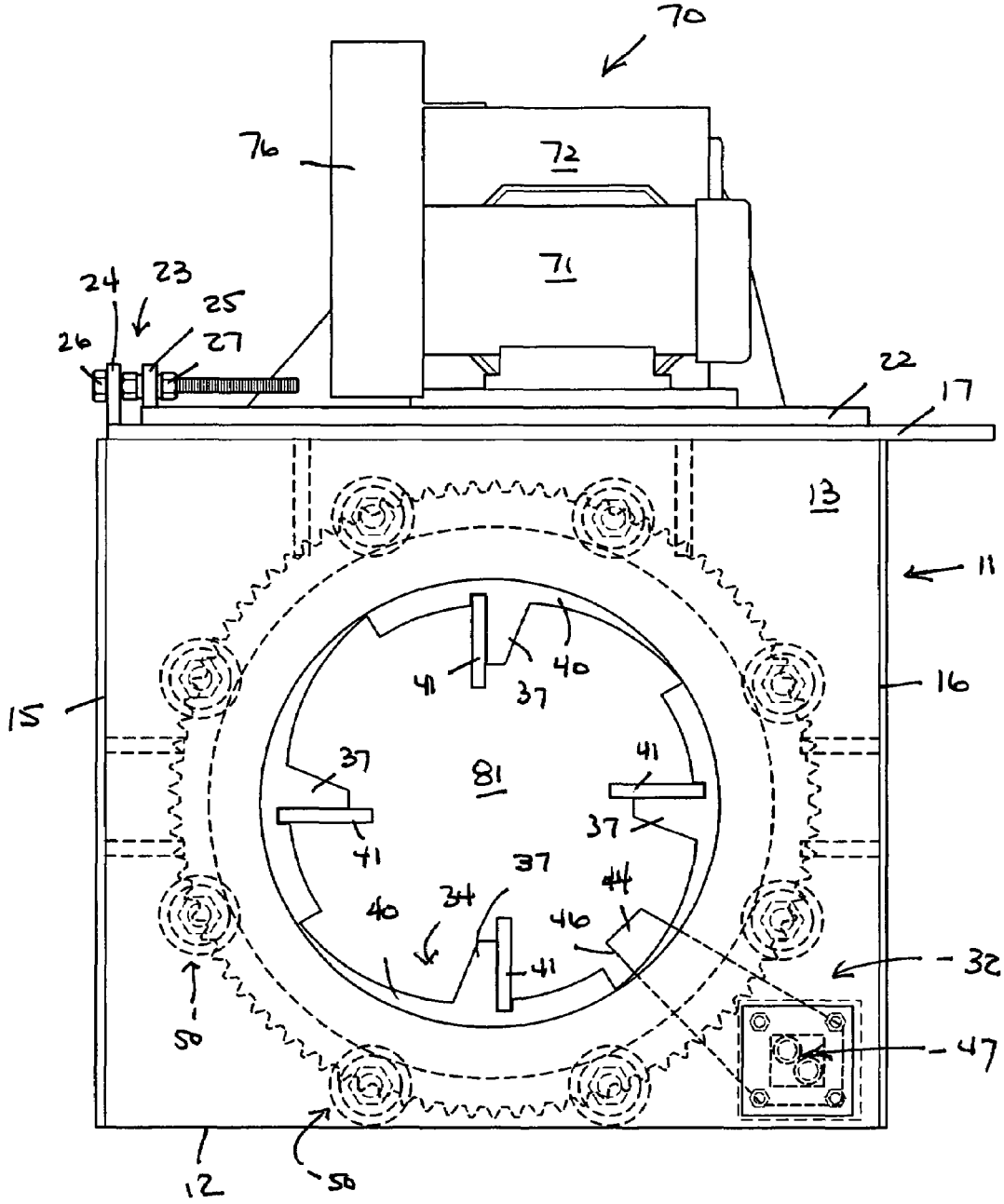
FIG. 2 shows a front view of shredder apparatus of FIG. 1.
Figure 4:
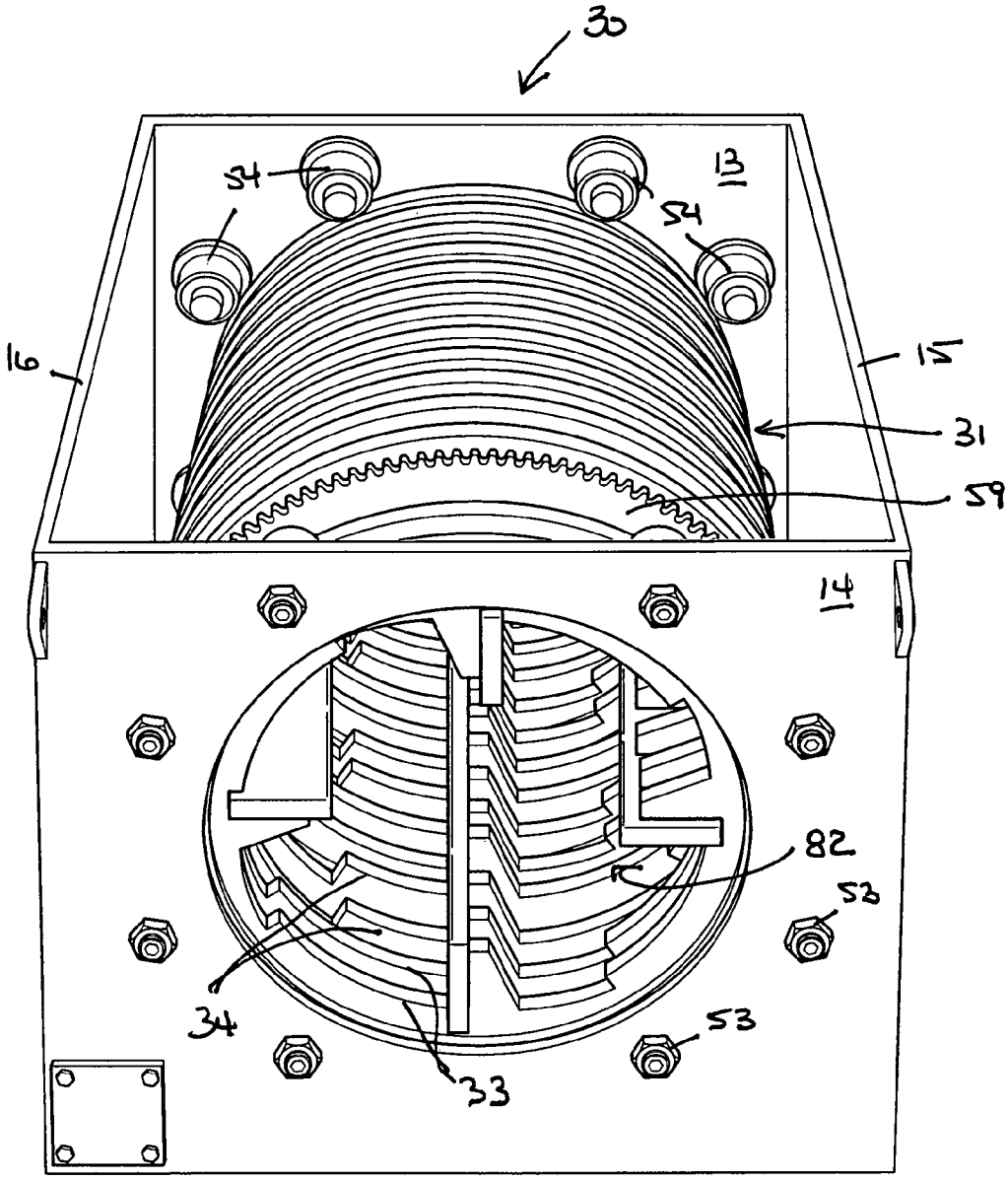
FIG. 4 shows a perspective rear view of the shredder apparatus of FIG. 1 with the drive assembly and top plate removed.

An exemplary shredder apparatus 10 comprises frame assembly 11 that, as illustrated in FIGS. 1, 2, and 4, includes base 12, front (end) wall 13, back or rear (end) wall 14 and side walls 15, 16. Top plate 17 is fixed at plate ends 18, 19 and sides 20, 21 to the frame assembly front, back and side walls 13, 14, 15, 16. Top plate 17 has an opening therein. A second top plate 22, which, if desired, can be hinged, is disposed on top of top plate 17 and covers the opening in plate 17. A conventional locking assembly 23, as illustrated in FIG. 2, holds plate 22 in place relative to plate 17. A first threaded boss 24 extends upwardly from plate 17 and a second threaded boss 25 extends upwardly from top plate 22. Bolt 26 extends through the two bosses and is held in place by nut 27.

Shredder assembly 30 is disposed within frame assembly 11. Shredder assembly 30 comprises a first, cylindrically-shaped shredder ring component 31 and a second shredder component 32 (see FIGS. 2, 3, and 12). Shredder ring and shredder components 31, 32 cooperate to shred material entering shredder apparatus 10 through an opening in front wall 13.

Figure 5A:
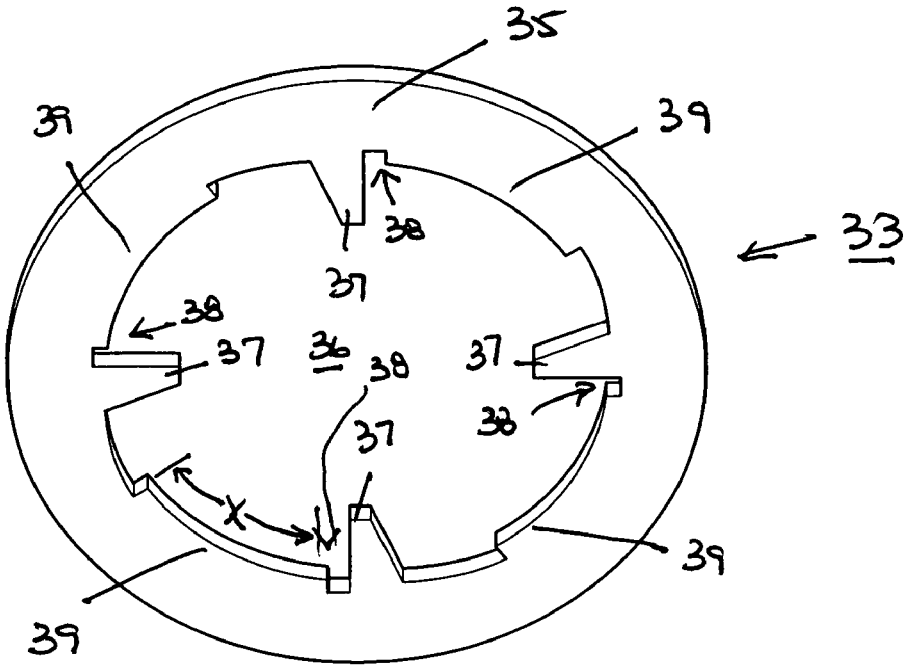
FIG. 5A shows a perspective view of a shredder ring having a first shredder portion.
Figure 5B:
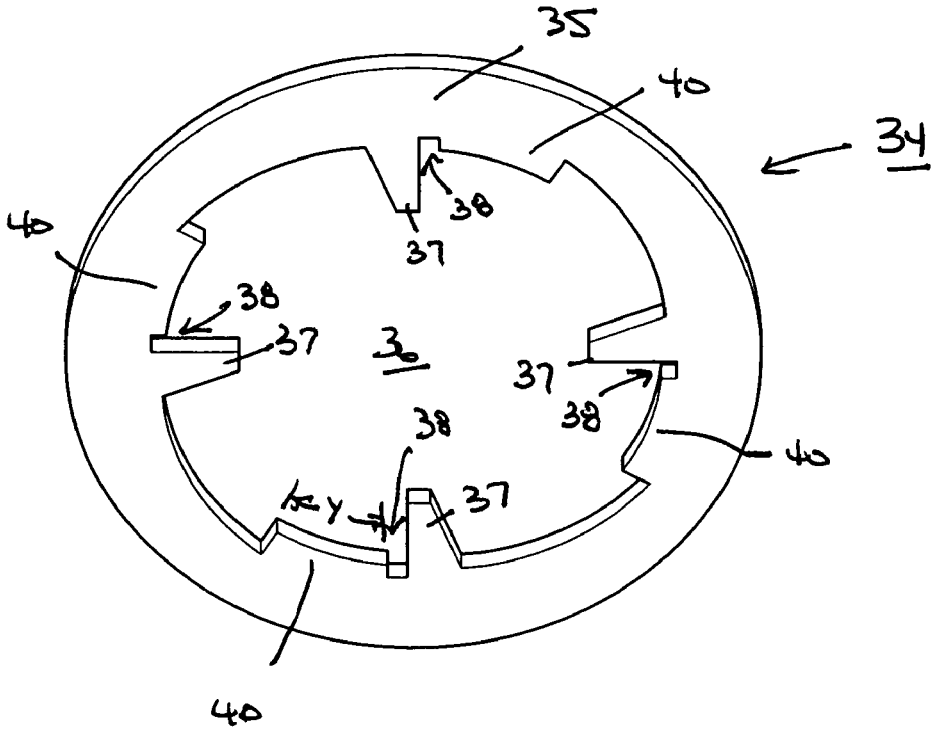
FIG. 5B shows a perspective view of a shredder ring having a second shredder portion.
Figure 9:
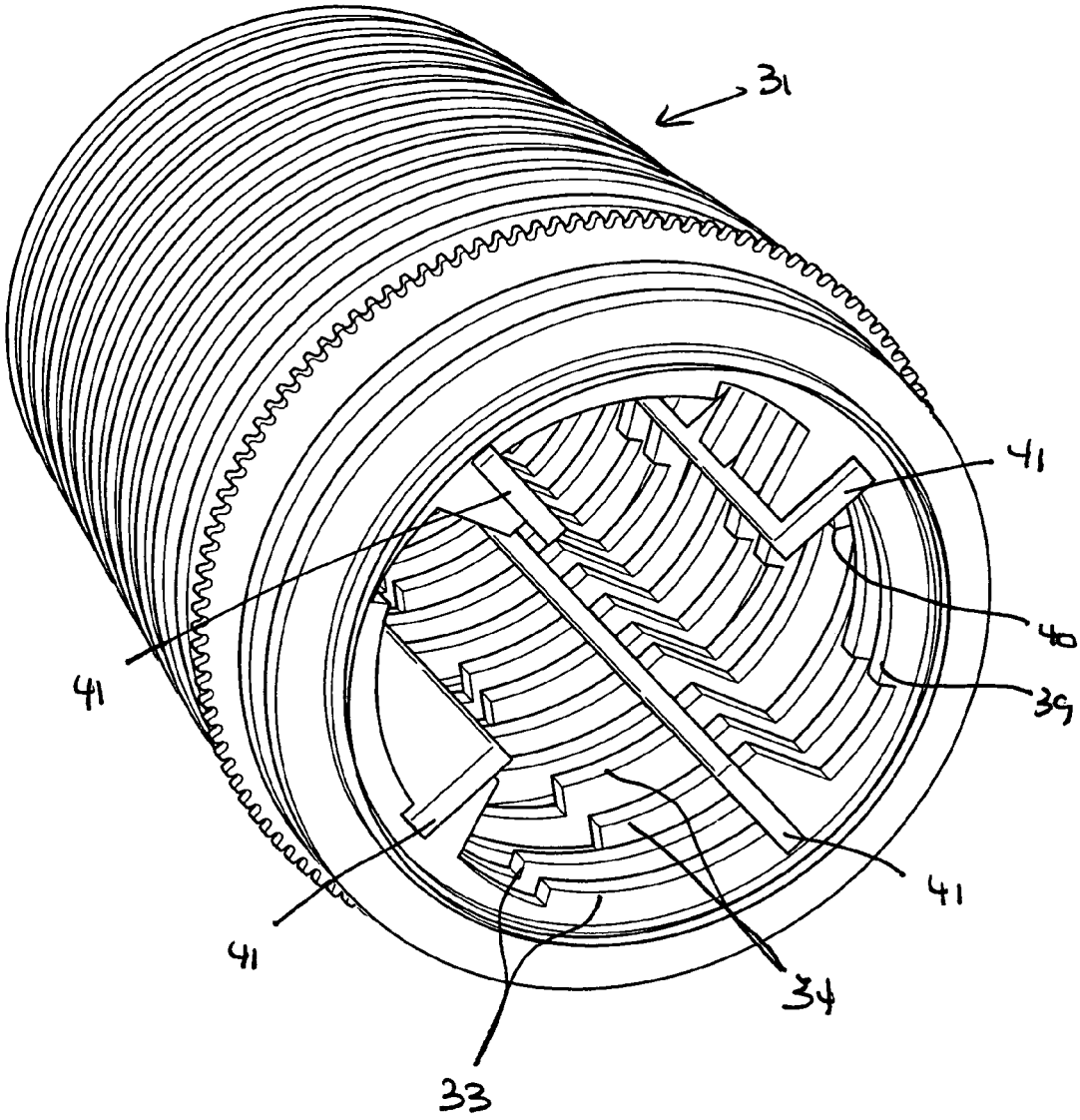
FIG. 9 shows a rear, or discharge end, perspective view of the shredder rings and spacer bars, as assembled.
Figure 10:
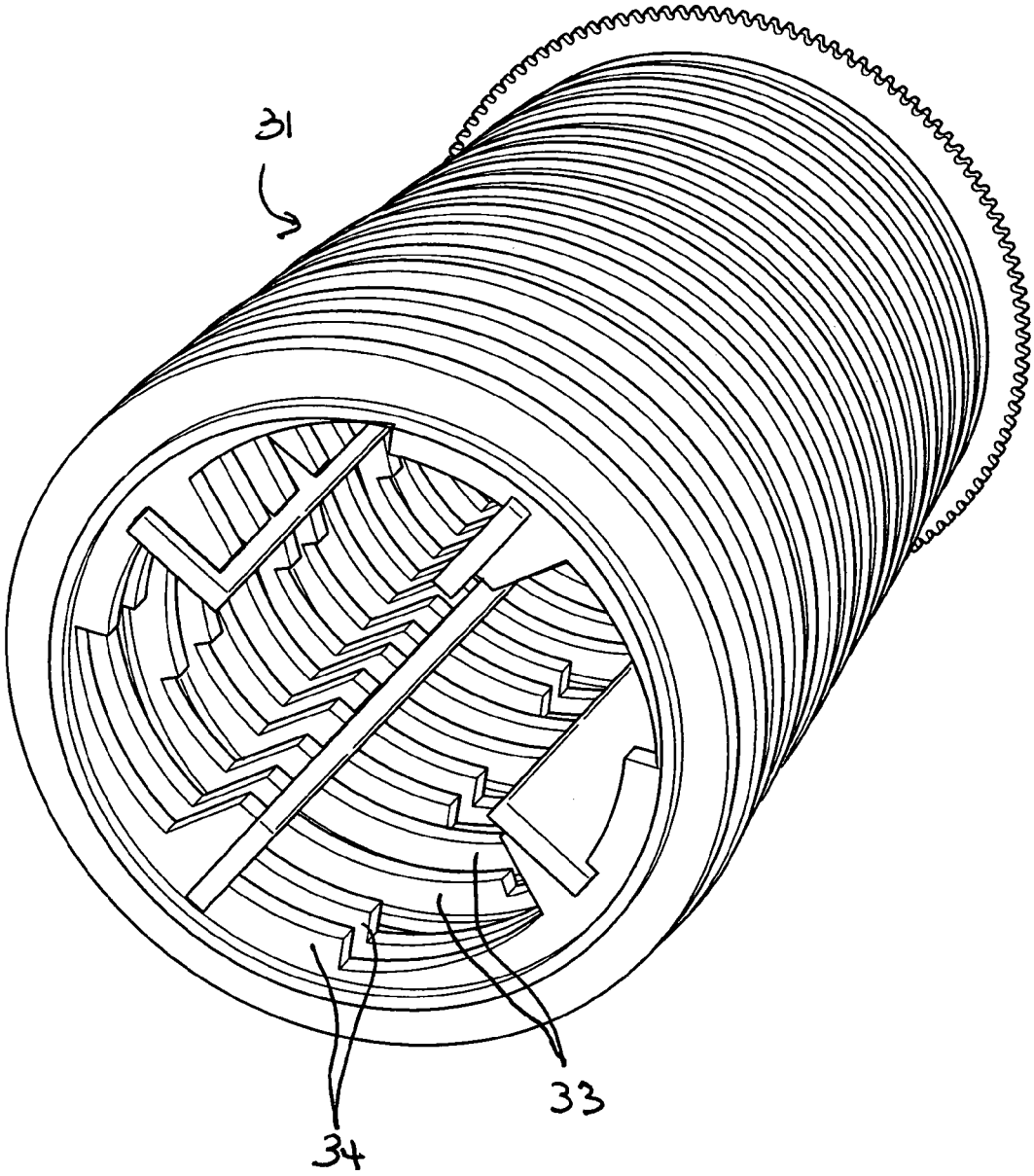
FIG. 10 shows a frontal perspective view of the shredder rings and spacer bars, as assembled.
Figure 11:
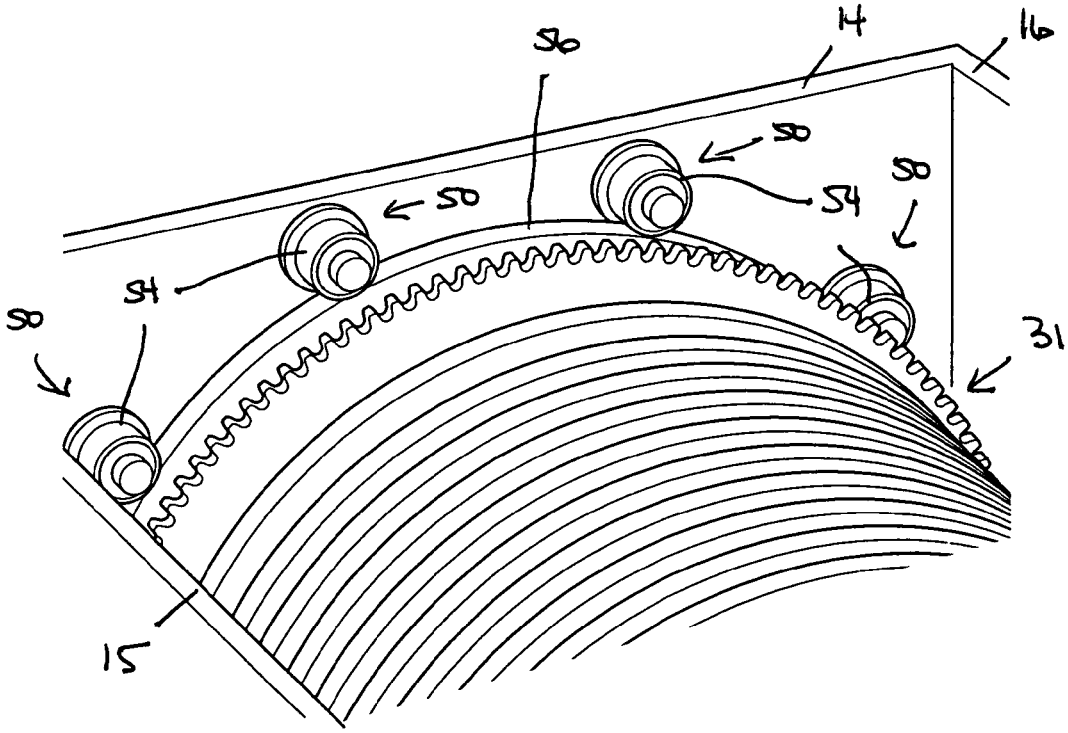
FIG. 11 shows an enlarged, partial perspective view of a plurality of cam followers contacting a surface of a shredder ring.

The shredder ring component 31 is a shaftless rotatable member made up of plurality of shredder rings 33, 34 (see FIGS. 9 and 11). As illustrated in FIGS. 5A and 5B, rings 33, 34 include an annular portion 35 bounded by a radially outer surface and a radially inner surface and having a thickness. The radially inner surface also defines a ring opening 36. Each ring 33, 34 includes a plurality of equally spaced projections 37 extending inwardly from portion 35 into ring opening 36. A recess 38 is located in ring portion 35 adjacent each projection 37.

Rings 33 have a plurality of spaced tapered shredder portions 39 (see FIGS. 2 and 5A), each having a first desired length "x". Rings 34 have a plurality of shredder portions 40 (see FIGS. 2 and 5B) each having a second desired length "y". The shredder portions 39, 40 are, as shown, formed integrally with or defined by the radially inner surfaces of the rings 33, 34.

Figure 8:
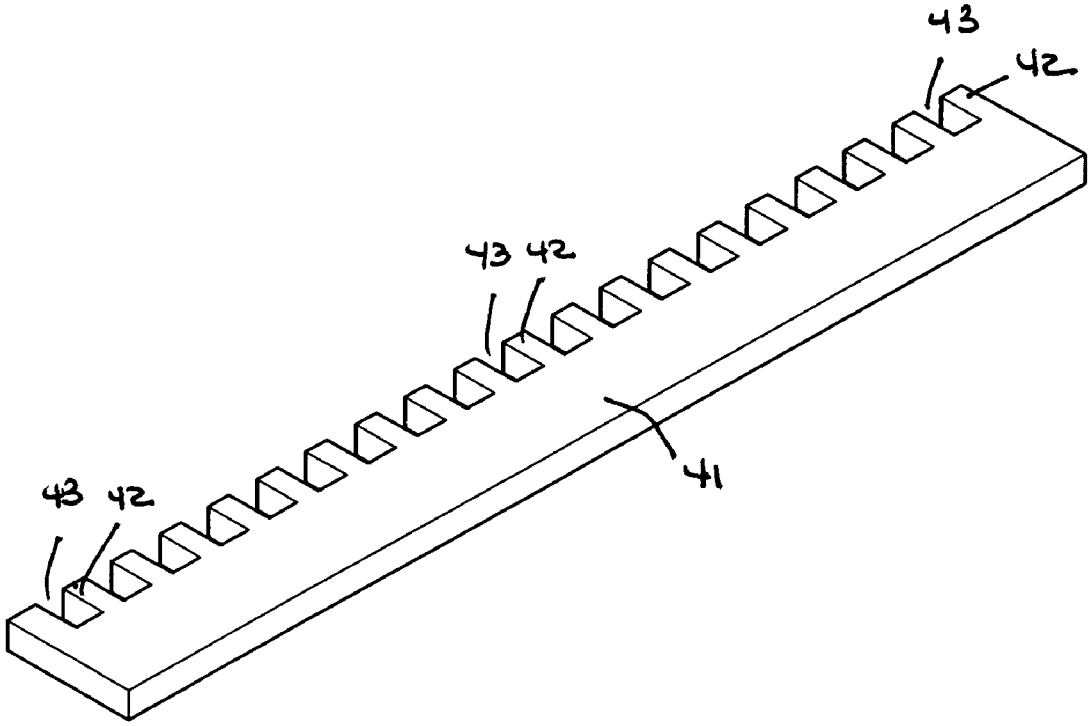
FIG. 8 shows a perspective view of a shredder ring spacer bar having a plurality of grooves located therein.

Turning to FIGS. 2, 4 and 8, the rings 33, 34 are spaced from each other by means of a plurality of spacer bars 41. As shown in FIG. 8, each spacer bar 41 includes a plurality of projections 42 along the length of one side of bar 41 to define a plurality of spaced grooves 43. As shown in FIGS. 2 and 4, each spacer bar 41 is positioned in one of the recesses 38 of each shredder ring 33, 34 and abuts one of the projections 37. Specifically, one of the spacer bar projections 42 will be disposed in one of the shredder ring recesses 38. Once the bar 41 is positioned relative to the plurality of cutter rings 33, 34, the bar 41 is fixed in place, for example, by welding.

It will be appreciated that while four, equally-spaced spacer bars are employed in this illustrative embodiment, other spacer bar arrangements could be employed to space and align the rings 33, 34 with respect to the shredder component 32 described below. Further, while, in the shredder ring component embodiment shown, a pair of spaced shredder rings 33 is shown positioned adjacent a pair of spaced shredder rings 34, other arrangements could be utilized. For instance, a single ring 33 could be positioned adjacent a single ring 34.

Figure 7:
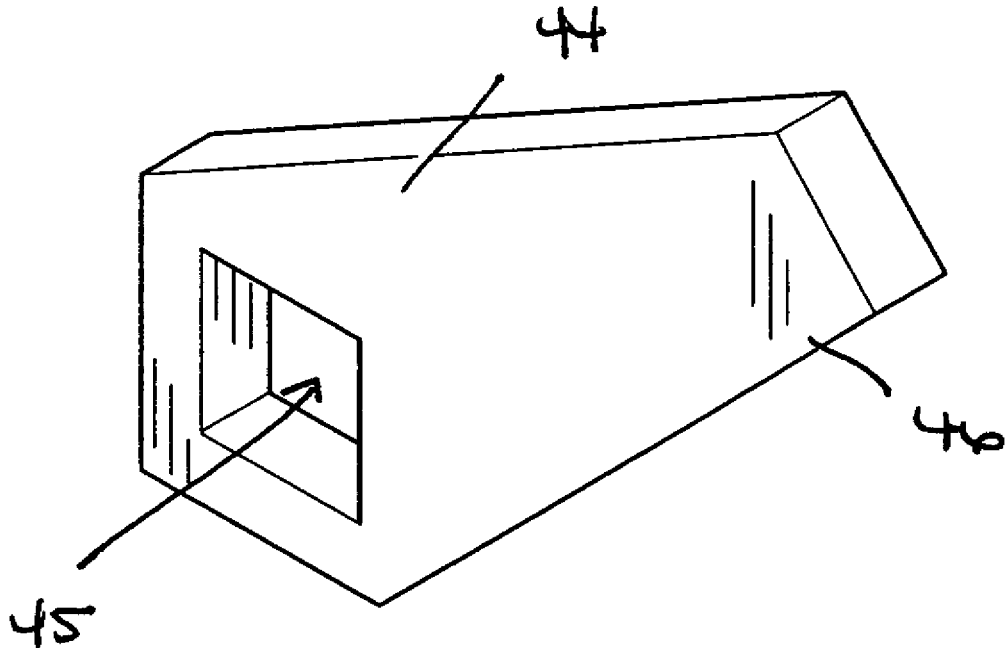
FIG. 7 shows a perspective view of a shredder comb member.

As shown in FIG. 7, for example, the secondary shredder component 32 comprises a plurality of spaced comb members 44. Each comb member 44 includes an opening 45 and a shredder portion 46. A bar 47 extends through each opening 45 to provide a plurality of aligned, spaced comb members 44.

The bar 47 is fixed to the frame assembly front and rear walls 13, 14 in any suitable manner, e.g., welding or a release bolt fastener such as illustrated in FIGS. 1, 2. Each comb member 44 is positioned on bar 47 so that it can cooperate with a shredder portion 39, 40 on shredder rings 33, 34. The comb members 44 are positioned on bar 47 so that they extend into and pass through the spacer bar grooves 43 during operation of shredder apparatus 10. The comb members 44 may move relative to the bar 47, although it is preferred to limit the movement of the comb members 44 relative to the bar 47, for example, through the cooperation of the cross-section of the bar 47 (which is square as shown) and the shape of the opening 45 (which is also square as shown) so that the component 32 is substantially stationary.

Figure 3:
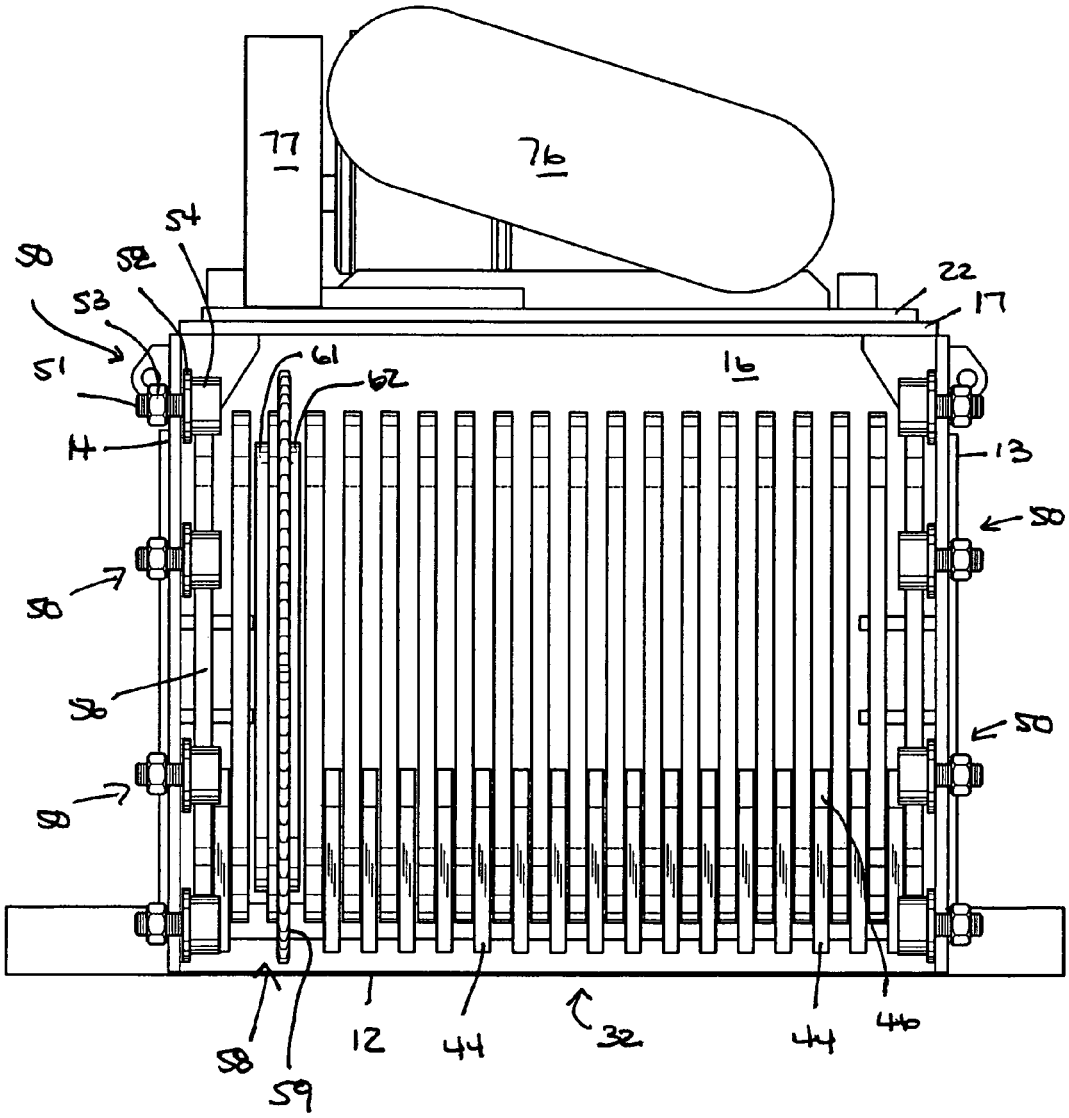
FIG. 3 shows a left side view of the shredder apparatus of FIG. 1.
Figure 12:
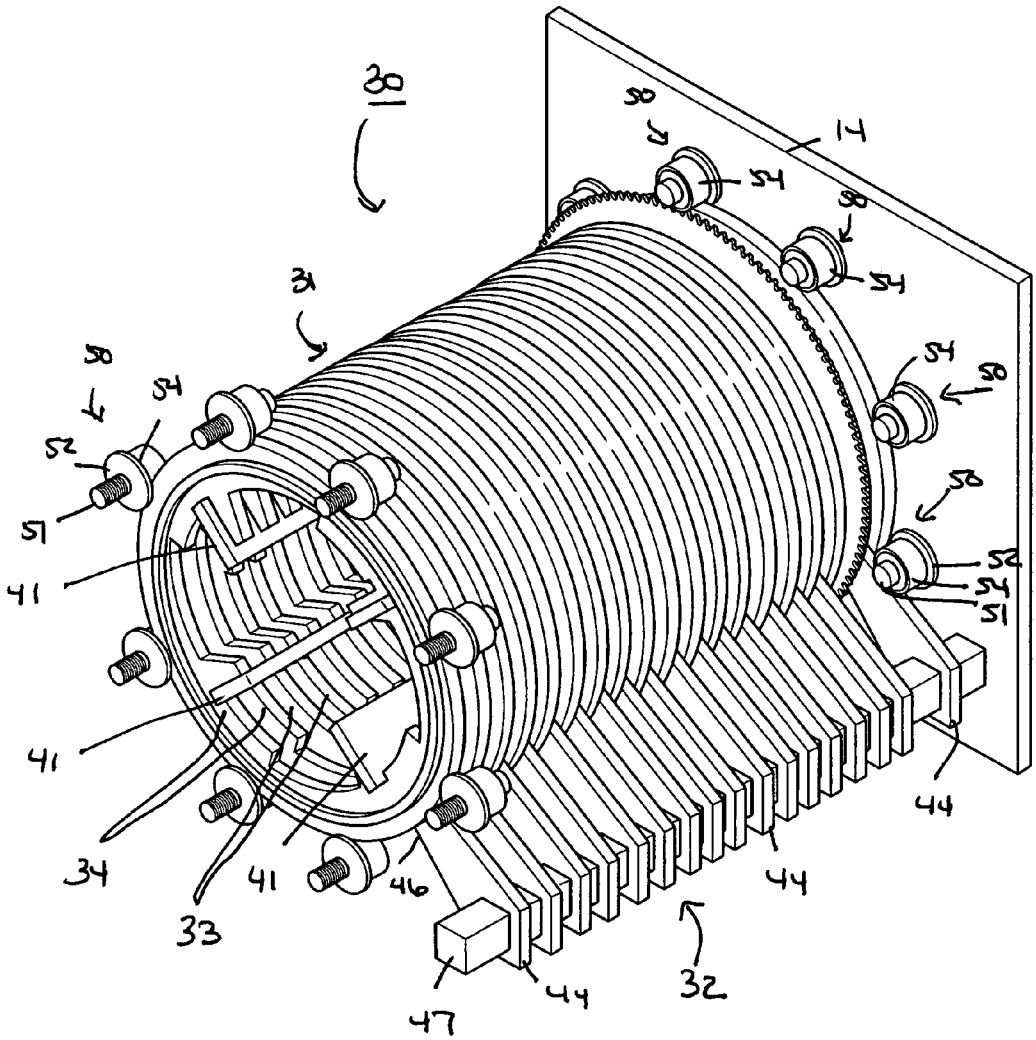
FIG. 12 shows a frontal perspective view of spaced shredder rings and comb members positioned relative to one another.

Shredder ring component 31 is positioned within frame assembly 11 so that the cylindrically-shaped structure extends from front wall 13 to rear wall 14. FIGS. 4 and 12, for example, illustrate a system for mounting shredder ring component 31 to frame assembly 11. A plurality of cam follower assemblies 50 are disposed on each end wall 13, 14. The assemblies 50 surround an opening in the end walls 13, 14. As shown in FIG. 3, cam follower assemblies 50 each include a bolt 5 1, washer 52, nut 53 and cam follower 54 in the form of a roller. Cam followers 54 position shredder ring component 31 in position within the frame assembly 11 while allowing for rotation of ring component 31. Rollers or cam followers 54, as illustrated in FIG. 11, contact the outer face 56 of each outboard shredder ring located contiguous to a respective frame assembly end wall 13, 14.

Figure 6:
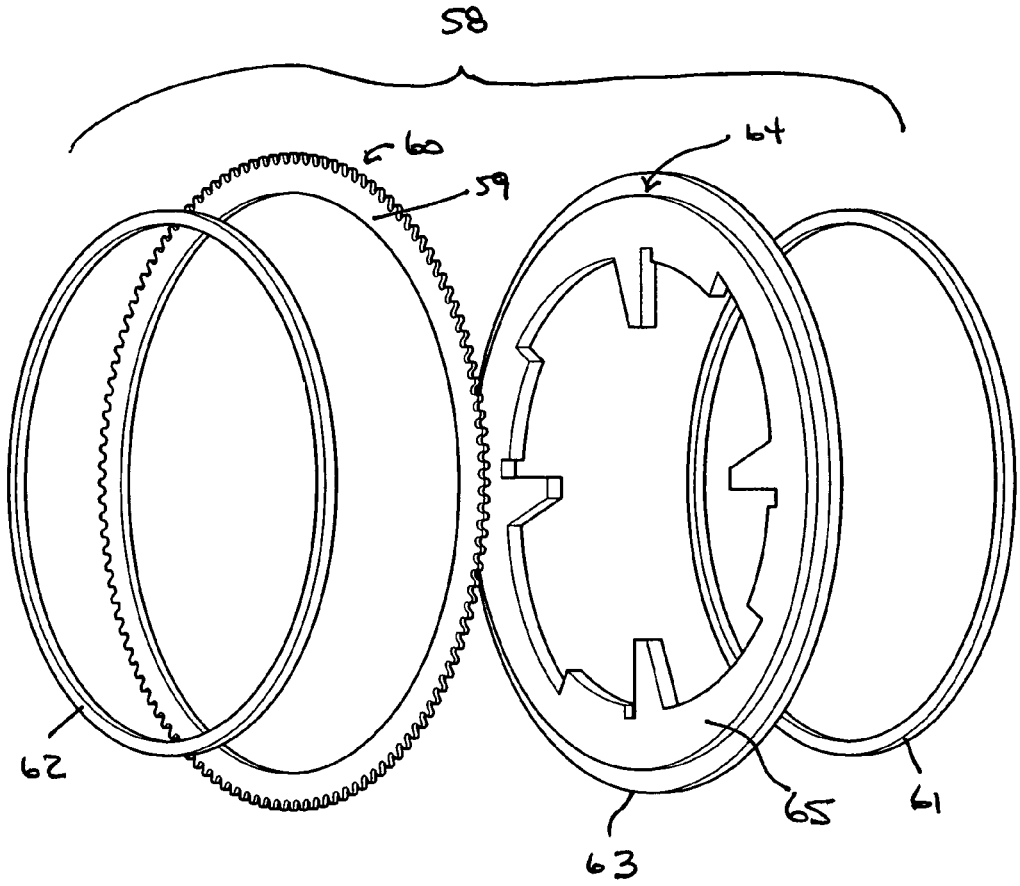
FIG. 6 shows an exploded view of a sprocket ring assembly.

Shredder ring component 31 also includes a sprocket ring assembly 58 that, as illustrated in FIGS. 3 and 6, includes shredder sprocket ring 59 having a sprocket 60, two spacer or shield rings 61, 62 and a modified shredder ring 63 having a recess 64 formed in the outer circular ring portion 65. Shredder ring 63, in this particular embodiment, is the same as shredder ring 34 save for recess 64 formed in annular portion 65. Sprocket ring 59 can be fixed in place in recess 64 of shredder ring 63 by any suitable means, such as, for example, welding.

FIG. 3 shows sprocket ring assembly 58 located on shredder ring component 31. The sprocket ring assembly 58 is disposed inwardly from the end of component 31 located contiguous to rear end wall 14. Spacer or shield ring 61 is located adjacent one side of shredder ring 63 and spacer or shield ring 62 is located adjacent the opposite side of shredder ring 63. Spacer or shield rings 61, 62 sandwich sprocket ring 59 between them. These spacer or shield rings 61, 62 shield the chain from contacting the adjacent shredder rings 63.

Figure 13:
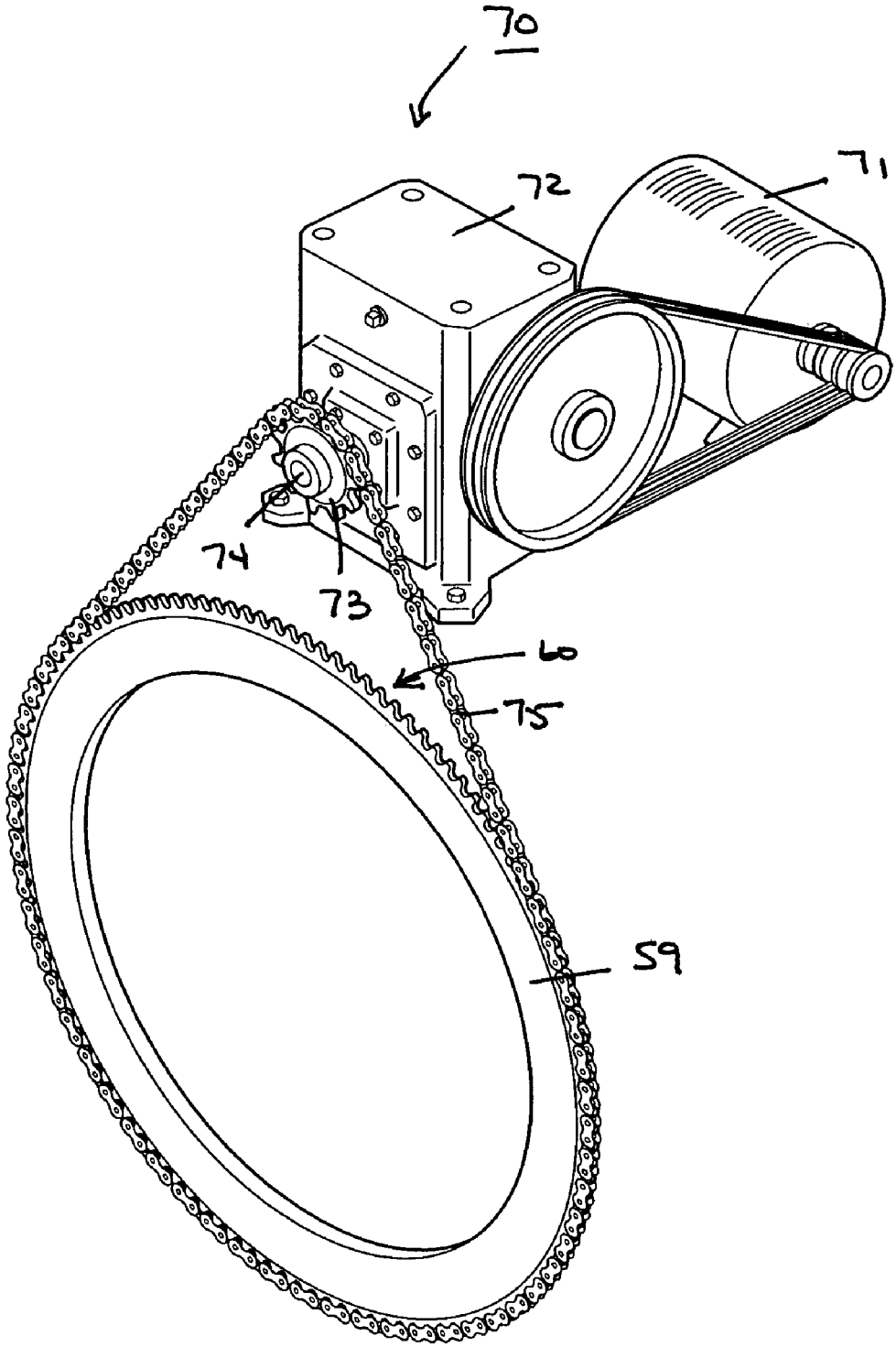
FIG. 13 shows a schematic diagram of a drive assembly employed in the shredder apparatus of FIG. 1.

As shown in FIG. 13, drive assembly 70 includes motor 71 having a drive shaft that is connected by belt drive to a conventional gear reducer 72. A drive sprocket 73 is attached to drive shaft 74 extending from reducer 72. Sprocket chain 75 connects drive sprocket 73 and sprocket ring 59. As shown in FIG. 3, for example, a cover 76 encloses the belt drive between motor 71 and reducer 72, and a cover 77 encloses the sprocket chain 75.

In operation, material to be shredded is directed to an inlet opening 81 in front end wall 13. Upon actuation of motor 71 of drive assembly 70, shredder ring component 31 rotates about its longitudinal axis which is substantially in-line with the incoming material to be shredded, as opposed to traversing the material. Shredder rings 33, 34 rotate whereby shredder portions 39, 40 cooperate with comb members 44 to shred the material passing through the openings 36 defined by the radially inner surfaces of the rings 33, 34. The shredded material continues on through shredder assembly 30 and discharges out of opening 82 in rear end wall 14. It has been found that having shredder portions 39, 40 of different lengths "x" and "y" assist in transporting the material to be shredded and shredded material along the length of shredder assembly 30.

Figure 15:
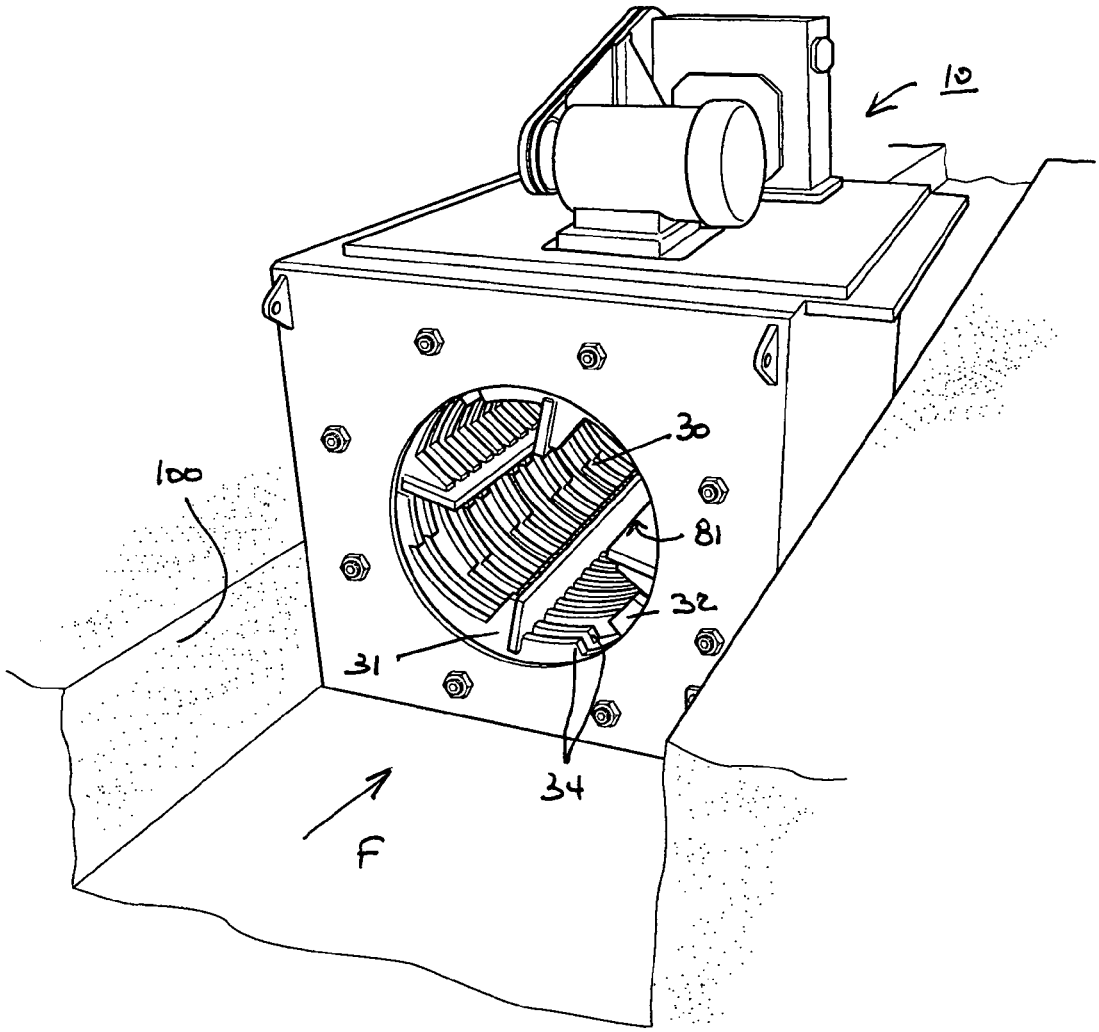
FIG. 15 shows a frontal perspective of the shredder apparatus of FIG. 1 disposed at least partially in a fluid flow path (e.g., a flume).

In some instances, where a shredder apparatus 10 is disposed at least partially in a fluid flow path 100 (as shown in FIG. 15), fluid and material to be shredded (e.g., wet chips) flow along the flow path 100 and through the shredder assembly 30 (as illustrated by the arrow marked "F"). In such a case, the fluid may also assist in directing or moving material to be shredded, being shredded or having been shredded through shredder assembly 30. For example, as shown in FIG. 15, the shredder apparatus 10, and in particular shredder assembly 30, is disposed at least partially in a fluid flow path 100, in this case defined, at least in part, by a flume. In other embodiments, the shredder apparatus 10 and/or shredder assembly 30 may be totally or almost totally disposed or submerged in the fluid flow path. The fluid (including coolant) flowing along the flume also passes through the shredder assembly 30 and directs the material (including wet chips and shredded wet chips) through the shredder assembly 30. Eventually, the fluid and shredded material passes out of the shredder assembly 30 and shredder apparatus 10 along the fluid flow path 100.

While shredder rings 33, 34 have been shown as having the same outer diameter, it is appreciated that, if desired, the shredder rings could be formed of varying diameters traveling from one end of the cylindrically-shaped shredder ring component 31 to the remaining end. In this embodiment, the cylindrically-shaped ring component would resemble somewhat of a cone-like or tapered shape, with the larger opening preferably contiguous the material feed end of apparatus 10.

Figure 14:
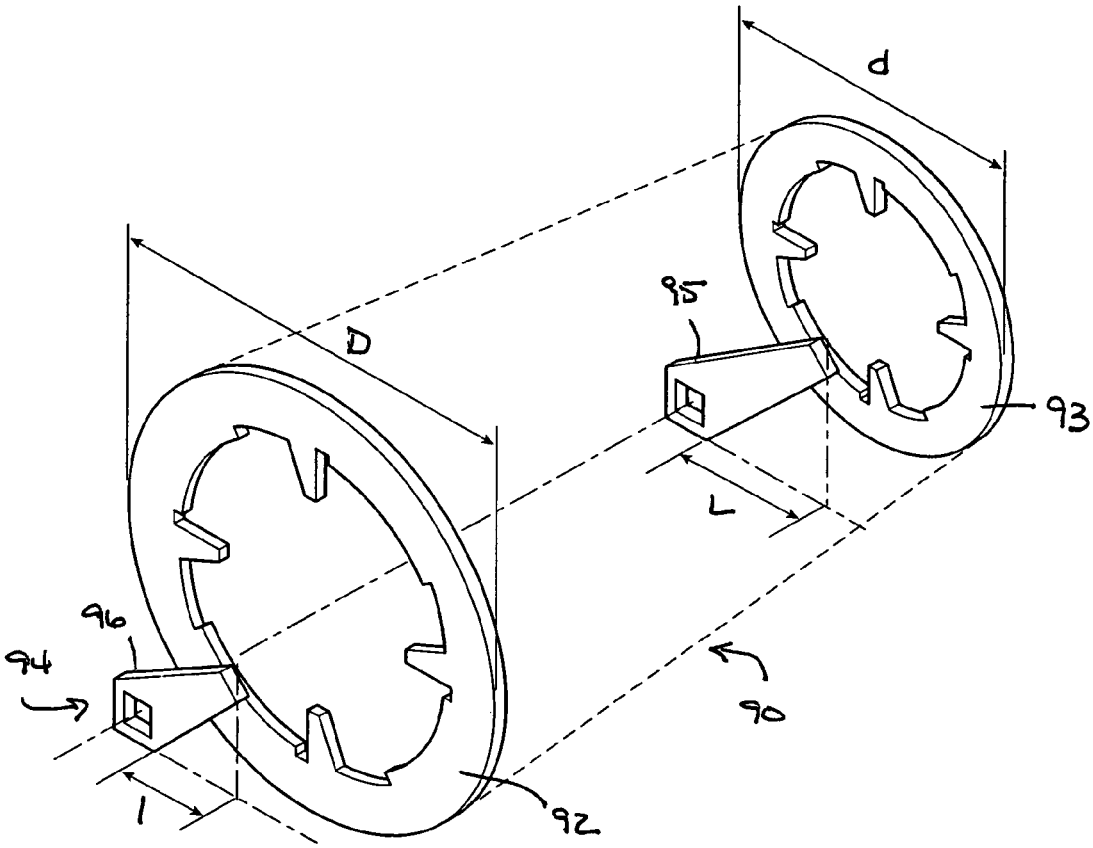
FIG. 14 shows a schematic diagram of a shredder assembly, wherein the shredder ring component is tapered and the secondary shredder component comprises comb members having shredder portions of different lengths.

FIG. 14 illustrates such an embodiment in which shredder ring component 90 has a tapered or cone-like shape. In this embodiment, the shredder ring 92 closest to the material feed end of component 90 would have the largest diameter, "D", in the component 90, whereas the shredder ring 93 nearest the exit end would have the smallest diameter, "d". Similarly, secondary shredder component 94 would also employ comb members having shredder portions of varying sizes, but in the lengths of the comb members would vary inversely to the diameters of the shredder rings. That is, the comb member 95 contiguous to the ring 93 would preferably have a greater length, "L", than the length, "l", of the comb member 96 located contiguous to ring 92.

Similarly, if desired, the tapered shredder portions of shredder rings 33, 34 could be arranged to form a helical shaped shearing path progressing from the feed end of shredder ring component 31 to the material discharge end. This could be accomplished by varying the length dimensions of "x" and "y" of the shredder portions to form a helical path.

Utilizing the embodiment shown and disclosed herein allows material to be shredded to enter a shredder assembly wherein the shredder assembly is substantially in-line with the material to be shredded. Moreover, the rotatable component comprises a shaftless ring component, as opposed to being mounted on a shaft.

Further, it may be desired to have the shredder rotation reverse in the event that a large piece of material to be shredded interferes with the shredder operation. The drive assembly 70 can be actuated to reverse the direction of shredder ring component 31 to allow the unwanted material to be cleared. A drive assembly utilizing this type of reversible drive assembly is disclosed in my heretofore-referenced pending U.S. patent application Ser. No. 10/611,526, filed Jul. 1, 2003, which has been incorporated by reference herein in its entirety.

While one or more embodiments have been illustrated and described in detail herein, it will be understood that modifications and variations thereof may be effected without departing from the spirit of the invention and the appended claims.

The invention claimed is:

1. A shredder apparatus for shredding materials, said apparatus comprising:

a frame assembly; and a shredder assembly disposed within said frame assembly, the shredder assembly including:

a shaftless, rotatable shredder ring component connected to said frame assembly, said shredder ring component comprising a plurality of spaced shredder rings, each of said rings having a shredder portion;

a comb member component disposed within said frame assembly, said comb member component comprising a plurality of spaced comb members, each of said comb members being positioned to cooperate with at least one of said shredder rings to shred material; and a drive assembly connected to said shredder ring component to rotate said shredder ring component including said shredder rings, whereby said shredder rings rotate relative to said comb members and cooperate with said comb members to shred material.

2. The shredder apparatus of claim 1, wherein:

said shredder ring component has an elongated length and first and second ends;

said frame assembly comprises first and second spaced walls, each of said walls having an opening therein; and said shredder ring component is disposed within said frame assembly whereby said first end of said shredder ring component is positioned contiguous to said opening in said first spaced wall and said second end of said shedder ring component is positioned contiguous to said opening in said second spaced wall, whereby material to be shredded enters said first end of said shredder ring component and travels substantially along the length of said shredder ring component.

3. The shredder apparatus of claim 2, wherein said shredder ring component is cylindrically-shaped along its length.

4. The shedder apparatus of claim 2, wherein said shedder ring component is tapered along its length.

5. The shredder apparatus of claim 2, wherein said shredder ring component includes a plurality of spacer bars extending along the length of said shredder ring component, each of said spacer bars connected to said shredder rings whereby said shredder rings are spaced from one other.

6. The shredder apparatus of claim 5, wherein said spacer bars each have a plurality of spaced grooves therein adapted to receive a comb member during the course of a shredding operation.

7. The shredder apparatus of claim 2, comprising:

a plurality of spaced cam followers disposed on said first spaced wall; and a plurality of spaced cam followers disposed on said second spaced wall, said shredder ring component including a cam surface located contiguous to said first and second ends of said component, and being disposed within said frame assembly whereby said cam followers on said first spaced wall contact one of said cam surfaces and said cam followers on said second spaced wall contact the other of said cam surfaces.

8. The shredder apparatus of claim 2, wherein said comb member component is substantially stationary within said frame assembly.

9. The shredder assembly of claim 2, wherein;

the plurality of shredder rings and the plurality of comb members are positioned principally orthogonal to the flow direction of the material from the first end to the second end of the shredder ring component.

10. The shredder apparatus of claim 1, wherein each of said rings has a plurality of shredder portions.

11. The shredder apparatus of claim 1, wherein at least one of the plurality of spaced shredder rings is annular in shape, and has a radially inner surface and a radially outer surface, the radially inner surface defining an opening and including the shredder portion, the shredder portion of the at least one of the plurality of shredder rings cooperating with at least one of the plurality of comb members to shred material passing through the opening defined by the radially inner surface.

12. The shredder assembly of claim 1, wherein:

said shredder ring component includes a sprocket ring assembly including a sprocket ring; and said drive assembly includes a motor assembly having a drive shaft, a drive sprocket connected to said motor assembly drive shaft, and a sprocket chain connecting said drive sprocket to said sprocket ring.

13. The shredder assembly of claim 12, wherein:

said shredder ring component includes a sprocket ring assembly including a sprocket ring; and said drive assembly includes a motor assembly having a drive shaft, a drive sprocket connected to said motor assembly drive shaft, and a sprocket chain connecting said drive sprocket to said sprocket ring.

14. The shredder apparatus of claim 1, wherein said comb member component is substantially stationary within said frame assembly.

15. A shredder apparatus for shredding materials, said apparatus comprising:

a frame assembly having spaced, opposite first and second ends, each end having an opening therein; and a shredder assembly disposed within said frame assembly, said shredder assembly comprising:

a first shaftless shredder ring component having first and second ends and an elongated length, said shredder ring component comprising a plurality of spaced shredder rings, each of said rings having at least one shredder portion, said shredder ring component being positioned within said frame assembly whereby said first end of said shredder ring component is contiguous to said first end of said frame assembly and said second end of said shredder ring component is contiguous to said second end of said frame assembly;

a second shredder component, said second shredder component comprising a plurality of spaced secondary shredder elements disposed within said frame assembly, each of said elements having a shredder portion;

a connecting assembly to connect said first end of said shredder ring component to said first end of said frame assembly contiguous to said opening in said first end and to connect said second end of said shredder ring component to said second end of said frame assembly contiguous to said opening in said second end; and a drive assembly connected to said shredder ring component for moving said shredder ring component relative to said secondary shredder elements whereby said shredder ring component and said secondary shredder elements cooperate to shred material in the shredder apparatus.

16. The shredder apparatus of claim 15, wherein said second shredder component is substantially stationary within said frame assembly.

17. The shredder apparatus of claim 15, wherein said shredder ring component includes a plurality of spacer bars positioned traverse to and connected to said shredder rings.

18. The shredder apparatus of claim 15, wherein said shredder ring component is cylindrically-shaped along its length.

19. The shredder apparatus of claim 15, wherein said shredder ring component is tapered along its length.

20. The shredder apparatus of claim 15, wherein each of said rings has a plurality of shredder portions.

21. The shredder apparatus of claim 15, wherein at least one of the plurality of spaced shredder rings is annular in shape, and has a radially inner surface and a radially outer surface, the radially inner surface defining an opening and including the at least one shredder portion, the at least one shredder portion of the at least one of the plurality of shredder rings cooperating with at least one of the plurality of secondary shredder elements to shred material passing through the opening defined by the radially inner surface.

22. The shredder apparatus of claim 15, wherein said shredder elements each comprise a comb member.

23. The shredder assembly of claim 15, wherein;

the shredder rings and the comb members are positioned principally orthogonal to the flow direction of the material from the first end to the second end of the shredder ring component.

24. A shredder apparatus for shredding materials, said apparatus comprising:

a frame assembly having spaced first and second end walls and side walls, a first opening in said first end wall and a second opening in said second end wall; and a shredder assembly disposed within said frame assembly, said shredder assembly including:

a first shaftless shredder ring component having an elongated length and first and second spaced ends, the first end of said shredder ring component end being positioned contiguous to said first opening of said frame assembly and said second end of said shredder ring component end being positioned contiguous to said second opening of said frame assembly, said shredder ring component comprising a plurality of spaced shredder rings, each of said rings including at least one shredder portion;

a second comb member component disposed in said frame assembly and comprising a plurality of spaced comb members, each of said comb members being adapted to cooperate with one of said shredder rings to shred material; and a drive assembly connected to said shredder ring assembly to rotate said shredder rings relative to said comb members whereby said shredder portions on said shredder rings cooperate with said comb members to shred material traveling along the length of said shredder ring component.

25. A system for shredding materials, the system comprising:

a shredder apparatus comprising a frame assembly and a shredder assembly disposed within said frame assembly, the shredder assembly including:

a shaftless, rotatable shredder ring component connected to said frame assembly, said shredder ring component comprising a plurality of spaced shredder rings, each of said rings having a shredder portion;

a comb member component disposed within said frame assembly, said comb member component comprising a plurality of spaced comb members, each of said comb members being positioned to cooperate with at least one of said shredder rings to shred material; and a drive assembly connected to said shredder ring component to rotate said shredder ring component including said shredder rings, whereby said shredder rings rotate relative to said comb members and cooperate with said comb members to shred material; and a fluid flow path, said shredder apparatus disposed at least partially in said fluid flow path, whereby fluid flowing along said fluid flow path and through said shredder apparatus assists in moving material through said shredder apparatus.

26. The system according to claim 25, comprising a flume, said flume defining, at least in part, said fluid flow path.

27. The method of shredding material with a shredder apparatus comprising a frame assembly having spaced, opposite first and second ends, each end having an opening therein, and a shredder assembly disposed within said frame assembly, said shredder assembly comprising: a first shaftless shredder ring component having first and second ends and an elongated length, said shredder ring component comprising a plurality of spaced shredder rings, each of said rings having at least one shredder portion, said shredder ring component being positioned within said frame assembly whereby said first end of said shredder ring component is contiguous to said first end of said frame assembly and said second end of said shredder ring component is contiguous to said second end of said frame assembly; a second shredder component, said second shredder component comprising a plurality of spaced secondary shredder elements disposed within said frame assembly, each of said elements having a shredder portion; a connecting assembly to connect said first end of said shredder ring component to said opening in said first end and to connect said second end of said shredder ring component to said opening in said second end; and a drive assembly connected to said shredder ring component for moving said shredder ring component relative to said secondary shredder elements whereby said shredder ring component and said secondary shredder elements cooperate to shred material in the shredder apparatus, said method including:

directing material to be shredded through said opening in said first end of said frame assembly and said first end of said shredder ring component;

moving said first and second shredder components relative to one another to shred material as the material travels along the length of said shredder ring component; and passing said shredded material through said second end of said shredder ring component and said opening in said second end of said frame assembly.

28. The method of shredding material of claim 27, including maintaining said second shredder component in a substantially stationary position during a shredding operation.

29. The method of shredding material of claim 27, including rotating said first shredder ring component relative to said second shredder component.

30. The method of shredding material with a shredder apparatus comprising a frame assembly and a shredder assembly disposed within said frame assembly, the shredder assembly including a shaftless, rotatable shredder ring component connected to said frame assembly, said shredder ring component comprising a plurality of spaced shredder rings, each of said rings having a shredder portion, a comb member component disposed within said frame assembly, said comb member component comprising a plurality of spaced comb members, each of said comb members being positioned to cooperate with at least one of said shredder rings to shred material, and a drive assembly connected to said shredder ring component to rotate said shredder ring component including said shredder rings; and a fluid flow path, the shredder apparatus disposed at least partially in the fluid flow path, said method including:

directing fluid and material to be shredded along said fluid flow path and through said shredder apparatus;

moving said shredder ring and comb member components relative to one another to shred material as said material travels through said shredder apparatus; and passing said fluid and said shredded material through and out of said shredder apparatus along said fluid flow path.

* * * * *